US008684255B2

(12) United States Patent
Franchet et al.

(10) Patent No.: US 8,684,255 B2
(45) Date of Patent: Apr. 1, 2014

(54) METHOD OF MANUFACTURING AN ELONGATE INSERT MADE OF A METAL MATRIX COMPOSITE

(75) Inventors: Jean-Michel Patrick Maurice Franchet, Paris (FR); Gilles Charles Casimir Klein, Mery sur Oise (FR); Richard Masson, Buc (FR); Louis Salvat, Tignieu Jameyzieu (FR)

(73) Assignees: SNECMA, Paris (FR); Messier-Bugatti-Dowty, Velizy Villacoublay (FR)

( * ) Notice: Subject to any disclaimer, the term of this patent is extended or adjusted under 35 U.S.C. 154(b) by 0 days.

(21) Appl. No.: 13/637,593

(22) PCT Filed: Mar. 30, 2011

(86) PCT No.: PCT/FR2011/050697

§ 371 (c)(1),
(2), (4) Date: Sep. 26, 2012

(87) PCT Pub. No.: WO2011/121232

PCT Pub. Date: Oct. 6, 2011

(65) Prior Publication Data

US 2013/0008582 A1 Jan. 10, 2013

(30) Foreign Application Priority Data

Apr. 1, 2010 (FR) ..... 10 52494

(51) Int. Cl.

| | |
|---|---|
| ***B32B 37/10*** | (2006.01) |
| ***D02G 3/24*** | (2006.01) |
| ***D02G 3/36*** | (2006.01) |

(52) U.S. Cl.
USPC ..... 228/121; 29/419.1; 29/525.14; 156/60; 156/169; 228/235.1; 428/374

(58) Field of Classification Search
USPC ..... 29/419.1, 525.14; 156/60, 169; 228/121, 235.1; 428/374
See application file for complete search history.

(56) References Cited

U.S. PATENT DOCUMENTS 3,187,422 A * 6/1965 Morgan ..... 29/419.1
3,609,855 A * 10/1971 Schmidt ..... 228/178

(Continued)

FOREIGN PATENT DOCUMENTS

FR 2 919 284 1/2009
FR 2 933 423 1/2010

OTHER PUBLICATIONS

International French Search Report Issued Jun. 9, 2011 in PCT/FR11/050697 Filed Mar. 30, 2011.

*Primary Examiner* — Devang R Patel
(74) *Attorney, Agent, or Firm* — Oblon, Spivak, McClelland, Maier & Neustadt, L.L.P.

(57) ABSTRACT

A method of manufacturing an elongate insert configured to be integrated by CIC in a metal container, including coated yarns bonded together, the coated yarns being formed from metal-coated ceramic fibers. The method includes placing the coated yarns side by side in a bundle and pulling the fiber bundle through a shaping element so as to compact the fiber bundle transversely while forming the fiber bundle so as to have a defined cross section. A metal part incorporating a fibrous insert can be manufactured by the CIC technique.

9 Claims, 2 Drawing Sheets

(56) References Cited

U.S. PATENT DOCUMENTS

| | | | | |
|---|---|---|---|---|
| 3,828,417 | A * | 8/1974 | Divecha | 29/419.1 |
| 3,864,807 | A * | 2/1975 | Schneider et al. | 148/530 |
| 3,882,587 | A * | 5/1975 | Schneider et al. | 29/419.1 |
| 3,889,348 | A * | 6/1975 | Lemelson | 419/8 |
| 4,335,494 | A * | 6/1982 | Lemelson | 419/3 |
| 7,511,248 | B2 * | 3/2009 | Franchet et al. | 219/121.64 |
| 7,774,912 | B2 * | 8/2010 | Gordon et al. | 29/419.1 |
| 2004/0020904 | A1 | 2/2004 | Andrees et al. | |
| 2005/0260398 | A1 * | 11/2005 | Owens | 428/304.4 |
| 2010/0291339 | A1 * | 11/2010 | Dunleavy et al. | 428/81 |
| 2011/0107579 | A1 | 5/2011 | Dunleavy et al. | |

* cited by examiner

METHOD OF MANUFACTURING AN ELONGATE INSERT MADE OF A METAL MATRIX COMPOSITE

BACKGROUND OF THE INVENTION

1. Field of the Invention

The present invention relates to the field of metal matrix composite materials and its subject is more particularly a method for manufacturing an insert formed of ceramic fibres in a metal matrix for reinforcing a metal part.

2. Description of the Related Art

Particularly in the aeronautics field, a constant aim is to optimize the strength of the parts for a minimal weight and footprint. Certain parts may now comprise an insert made of metal matrix composite material hereinafter called CMM, the part also being able to be monolithic. Such a composite material comprises a metal alloy matrix, for example of titanium alloy Ti, within which fibres extend, for example silicon carbide SiC ceramic fibres. Such fibres have a tensile strength that is markedly greater than that of titanium (typically 4000 MPa as opposed to 1000 MPa). It is therefore the fibres that absorb the forces, the metal alloy matrix performing a binder function with the rest of the part, and of protection and of isolation of the fibres, which must not come into contact with one another. Moreover, the ceramic fibres are erosion resistant but must necessarily be reinforced by metal.

These composite materials can be used in the manufacture of discs, of shafts, of cylinder bodies, of housings, of struts, such as reinforcements for monolithic parts such as blades, etc.

For compressor discs in a turbojet for example, a known reinforcement technique consists in inserting into the part a circular winding of coated fibres. One technique for manufacturing a CMM insert relies on the principle of winding coated yarns described in patent EP 1.726.677 filed in the name of Snecma. The insert is obtained from a plurality of coated yarns each comprising a ceramic fibre covered with a metal sheath. This type of yarn is called a coated yarn hereinafter. The manufacture comprises a step of winding a bundle or a bound layer of coated yarns around a part of revolution perpendicularly to the axis of the part. The insert is then subjected to a step of hot isostatic compression in a container. A container is a metal part blank into which a cavity has been machined for receiving the insert made of CMM material and which is then subjected to a hot isostatic compaction treatment. This treatment is called CIC hereinafter.

The parts described thus obtained are of circular type and are particularly suitable for not only compressor discs but for the production of circular parts such as shafts, cylinder bodies or housings.

Other mechanical parts require properties that differ from those presented by the circular parts. This is particularly the case of the connecting rods used for example in landing systems or of the structural parts such as engine suspensions, that are essentially of oblong shape. The function of these parts is to transmit a one-way traction and/or compression force. The reinforcement of these parts then requires inserts made of CMM that are rectilinear or substantially rectilinear in shape, at least in part. Specifically, the fibres must be oriented in the direction of the forces.

The manufacture of these inserts in an industrial manner and at least cost is awkward.

A method is known for manufacturing a mechanical part comprising at least one insert made of CMM material. The method comprises the manufacture of an insert blank by winding a bundle or a bound layer of coated yarns about an annular support of which a portion comprises a rectilinear or substantially rectilinear section.

The method described in patent FR 2.919.284 in the names of Snecma and Messier-Dowty develops this principle and then comprises the insertion of the insert blank hereinabove in a first metal container, the hot isostatic compaction of the first container, followed by the machining of the latter in order to form an insert element. After the manufacture of this insert element, the method for manufacturing a mechanical part comprises the following steps: insertion of the insert element into a second container, hot isostatic compaction of the second container and machining of the second container in order to form the desired mechanical part. The mechanical part thus obtained, for example a connecting rod, advantageously makes it possible to transmit one-way traction and/or compression forces in the direction of the ceramic fibres that have been incorporated therein.

Instead of passing through the intermediate step of compaction of the insert blank followed by cutting it into rectilinear insert elements, it would be possible to envisage cutting the annular coil forming the blank while keeping the coated yarns in a bundle. Patent application FR 2.925.896 teaches of the incorporation of this type of bundle in a rectilinear groove opening out at its ends.

This solution has several drawbacks which have an effect on the industrialization of these operations:

The coated yarns are lost in the non-straight portions. This loss is not insignificant because the half-produced coated yarn represents a considerable cost in the total cost of the part.

The winding, notably on oval shapes, induces stresses in the wound insert that risk being released which results in a deformation of the insert when cut.

These techniques require increasing the number of systems for keeping the coated yarns in line with the cutting zones.

Moreover, a technique based on coiling by winding a layer of previously assembled coated yarns is aimed essentially at the production of inserts with a cross section, perpendicular to the fibres, that is square or rectangular.

For certain applications, it would be desirable to have an insert with a section that is not square or rectangular in order to improve the absorption of forces between the composite insert and the rest of the structure of the part. Specifically, reinforcements with a cross section that is for example trapezoidal or elliptical would make it possible to prevent or at least to limit the leaps in stiffness and thus improve the mechanical strength of the transition zones.

For example, for elongate parts such as parts of landing gear, or connecting rods for suspending the engine comprising lateral attachments between their ends, a reinforcement in which the number of fibres is smaller along the edge of the part secured to the attachment allows a better transition of the forces at this attachment.

BRIEF SUMMARY OF THE INVENTION

The objective of the present invention is to perfect a technique for producing inserts that is of reduced cost and is easy to industrialize.

A further object of the invention is a manufacturing technique that allows the production of inserts that are called shaped, that is to say of which the cross section may be different from the square or rectangular shape.

This object is achieved with a method for manufacturing an insert of elongate shape designed to be incorporated by CIC into a metal container, comprising coated yarns bound together, the said coated yarns being formed of metal-coated ceramic fibres, characterized in that it comprises a step consisting in placing the coated yarns side by side in a bundle consisting of a plurality of layers of coated yarns, in pulling the bundle of coated yarns through a shaping element so as to compact it transversely while forming it with a determined cross section by the shaping element, and in placing straps transversely clamping the bundle, downstream of the shaping element.

Preferably, the bundle is shaped from coated yarns that are unwound from yarn reels.

The bundle of yarns, before it passes through the shaping element, has interstitial spaces resulting from the circular section of the coated yarns. The shaping element is dimensioned so as to reduce the spreading of the yarns and the interstitial spaces while giving the bundle the desired shape. The problem of industrialization and the shaping of the bundle of yarns is thus simply resolved. The passageway cross section of the shaping element is chosen freely depending on the shape, in the transverse plane, that is desired for the insert.

According to one embodiment, the shaping element comprises at least two rotary rollers, the axes of the two rollers being oriented perpendicularly to the direction of travel of the coated yarns. In order to complete the contour, the shaping element notably comprises lateral supports fixed between the rollers. The shaping element may also comprise a plurality of rollers forming the contour of the passageway cross section. The function of the rollers is to reduce the friction on the bundle of coated yarns while accompanying its movement. Fixed elements are also suitable to the extent in which the friction of the fibres is reduced.

It is thus possible to shape a shaping element of which the passageway cross section is polygonal with sides that are rectilinear or curved or else of oval or circular cross section.

In order to ease the guidance of the fibres to the shaping element and subsequently to keep them together in the bundle, a metal sheet, also called foil, is advantageously interposed between the coated yarns of the bundle and at least one portion of the sides of the shaping element.

The assembly of the coated yarns is maintained by collars or rings placed along the insert downstream of its passage through the shaping element. The rings are formed for example of a metal sheet forming a strap with which the bundle is surrounded tightly and of which the ends are welded after they are folded over one another.

The bundle of coated yarns is then cut to the desired length corresponding to the length of the insert to be placed in the metal container. In order to prevent the spreading of the coated yarns at ends of the insert, making it difficult to handle the latter and to place it in the container, it is wise to saw the bundle through a clamping ring because the portions of ring obtained are placed at the end and provide the clamping of the bundle.

According to one embodiment of the method, the coated yarns, before they are combined into a bundle, are guided in their movement towards the shaping element so as to form subassemblies or elementary bundles. These may be layers that are superposed on one another to form the said bundle. An elementary bundle is formed by simultaneously unwinding the coated yarns of the subassembly from separate reels. For example it is possible thus to form a stack of layers of rectilinear coated yarns obtained by flatly juxtaposing a determined number of coated yarns until a determined number of layers is obtained. More particularly, a first layer is placed on a bearing surface, notably comprising a metal sheet, and the last layer is overlapped through the shaping element. Instead of layers, the elementary bundles may have any cross-sectional shape.

According to another embodiment, the coated yarns are combined into elementary bundles in a plurality of guides, channels or tubes that are placed so as to converge on the passageway cross section of the shaping element.

The method of the invention is a step of a method for manufacturing a metal part comprising the incorporation of the insert and carried out in a metal container and the hot isostatic compaction of the assembly, as described for example in patent application FR2933422 or application FR2933423 in the name of Messier Dowty.

According to this type of method, at least one housing for an insert is machined in a metal body forming the container, the said insert is placed in the housing, a metal cover is placed on the body so as to cover the insert, the cover is welded onto the metal body, the assembly of the metal body with the cover is welded by hot isostatic compression and the said treated assembly is machined to obtain the said part.

The solution of the invention allows the incorporation of the insert in a container, immediately downstream of the shaping element. For example, the container may comprise a longitudinal through-housing into which the bundle of coated yarns is slipped. In this case, it is possible to dispense with the retaining rings or even with the longitudinal foils.

The invention also relates to a part of elongate shape comprising at least one fibrous reinforcement in the longitudinal direction, the said part being obtained according to the previous method, of which the cross section of the reinforcement has a shape that is not rectangular or square, such as a trapezoidal or oval shape.

BRIEF DESCRIPTION OF THE SEVERAL VIEWS OF THE DRAWINGS

The invention will be better understood and other objects, details, features and advantages of the latter will appear more clearly in the course of the following detailed explanatory description of embodiments of the invention that are given as purely illustrative and non-limiting examples with reference to the appended schematic drawings.

In these drawings

DETAILED DESCRIPTION OF THE INVENTION

Figure 1:
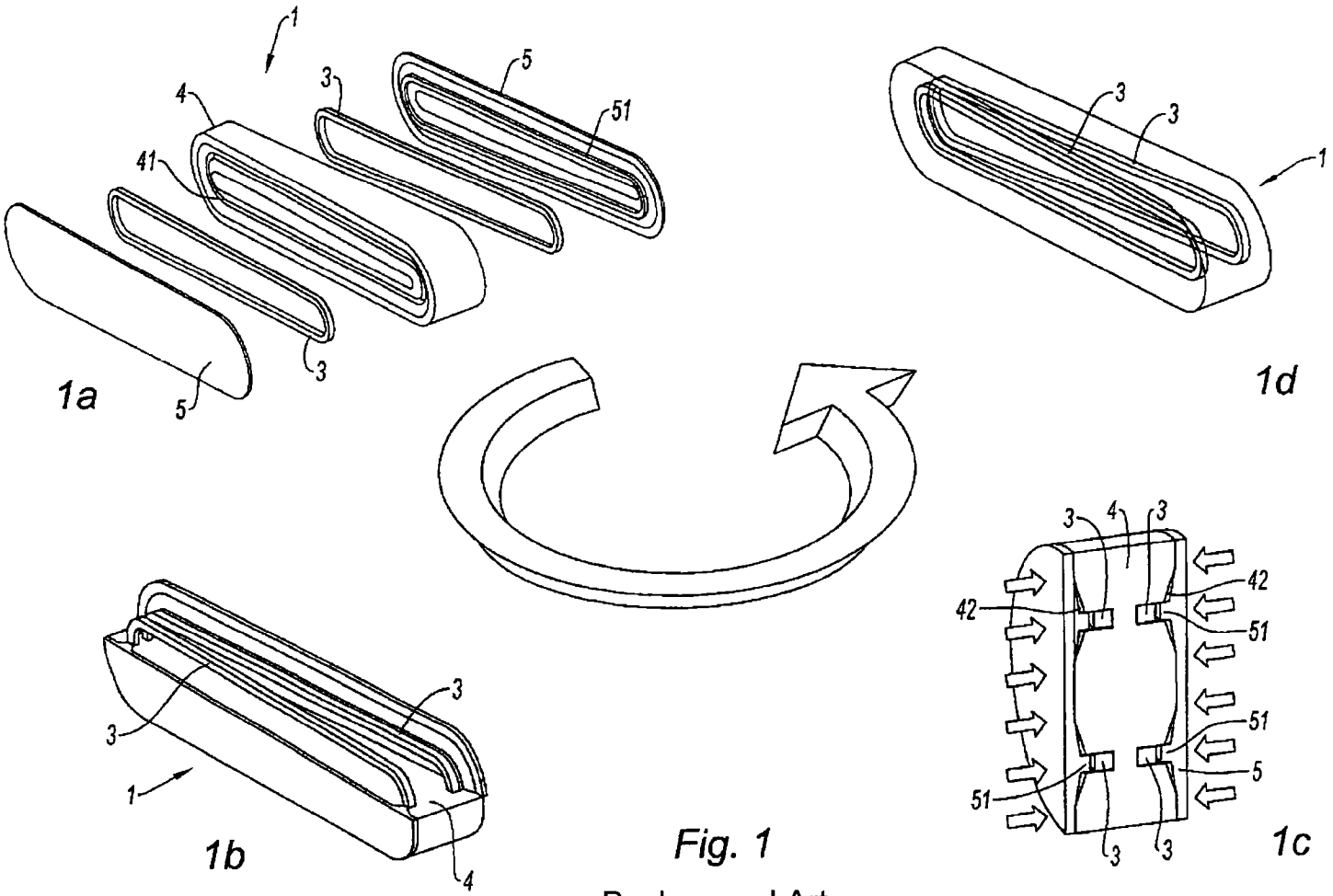
Fig. 1 Background Art
FIG. 1 shows the various steps 1*a* to 1*d* for manufacturing a part of elongate shape according to the prior art.

FIG. 1*a*, extracted from patent application FR 2.919.284 in the names of Snecma and of Messier-Dowty, shows a container 1 with a main body 4 of elongate shape designed to form a connecting rod of a landing gear for example. A groove 41 has been machined on each of the two faces of the body 4. This groove allows the housing of an insert 3 which comprises two rectilinear portions which may or may not be parallel with one another joined together at the ends by a circularly arcuate portion. The inserts are of the type with ceramic fibres coated with metal such as titanium.

The grooves and the inserts are of matching shapes so that the insert is fitted without clearance in the groove. Note that the groove in the container and the tenon on the cover must be assembled perfectly in order to prevent the fibres, that have a very small diameter, of the order of 0.25 mm, from escaping during the hot isostatic compaction. Two covers 5 are provided with a protruding portion forming a tenon 51 and cover the faces of the body 4. The tenon rests on the insert housed in the groove and plugs the latter. The cover 5 is welded, for example by electron beam, to the body 4 ensuring a vacuum inside the container.

The container can be seen in FIG. 1*b*; it is partly cut away in order to show the inserts. The container is then placed in an appropriate enclosure in order to sustain therein a hot isostatic compaction treatment. The object of this treatment is to secure to one another the container, its cover and the layers of coated yarns and to form a monolithic part. The cross section of the container of FIG. 1*c* shows that the edges 42 of the groove 41 are bevelled so as to arrange a clearance with the portion of the cover 5 that is adjacent to the tenon 51. During the hot isostatic compaction operation, pressure is exerted in the direction perpendicular to the surface of the cover generating the collapse of the covers.

The heat and the pressure, respectively of the order of 1000° C. and 1000 bar, allow the metal of the matrix to fill the empty spaces between the coated yarns forming the insert. The volume of the insert reduces by approximately 23%. The tenon is thus moved in the direction of the bottom of the groove and the clearance on either side of the tenon is absorbed. At the end of the process, the metal portions are welded together by diffusion and the insert of coated yarns is compacted; the part is thus reinforced by the coated yarns trapped in the solid block.

FIG. 1*d* shows the part blank obtained with two inserts that can be seen transparently. The blank is then machined so as to obtain the desired part. The ceramic fibres are thus incorporated into the zones of the part that transmit the tension and compression forces.

The inserts used according to the teaching of this patent FR 2 919 283 are of annular shape but as has been described in patent application FR 2 919 284, they can be formed of elongate bar-shaped elements. In the latter case, the inserts are incorporated, according to the technique explained in this document, in the container after having been compacted beforehand.

The production of the rectilinear inserts according to FR 2 919 284 comprises the winding of the coated yarns around a coiling device of annular shape with rectilinear portions. The shape may be oblong, with rectilinear portions, or else polygonal in which the sides of the polygon form the rectilinear portions.

After formation of the winding of the coated yarn or yarns in a collar, the turns of the collar are immobilized with respect to one another by means of welded metal straps. The assembly is incorporated into a container and sustains a hot isostatic compaction treatment according to the technique described above. From the semi-finished part, compact inserts of elongate shape are machined that are incorporated individually into containers for the manufacture of parts with ceramic fibre reinforcements.

According to the invention, the production of the inserts is simplified by forming inserts of elongate shape consisting directly of coated yarns 13 assembled like bunches or bundles.

Figure 2:
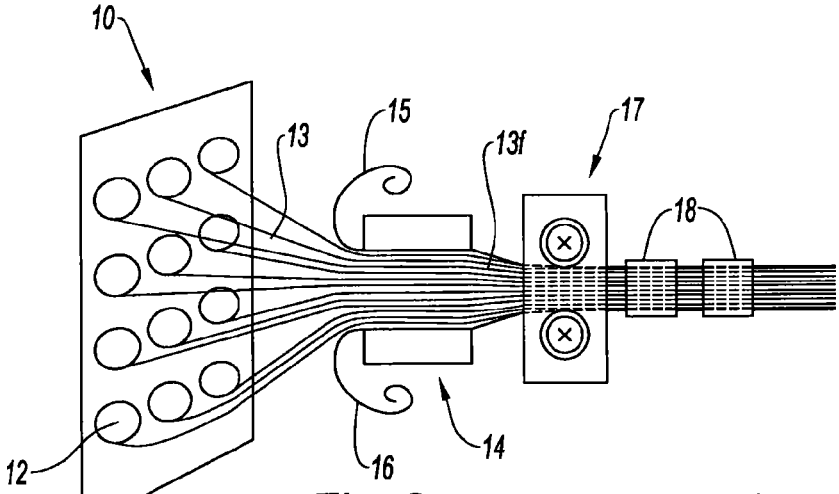
FIG. 2 represents a side view of an installation for manufacturing a rectilinear insert according to the invention.

With reference to FIG. 2, a typical installation allowing the implementation of the method of the invention comprises a spool 10 supporting a plurality of rows of reels 12 onto which the coated yarns 13 are wound. The coated yarns are pulled from their respective reels in a system of channelled slides 14 on which they converge. The system brings the coated yarns together in a bundle. At this stage, the bundle is relatively spread. The coated yarns are advantageously placed in a plurality of subassemblies or layers of juxtaposed coated yarns 13 that are parallel with one another.

A foil or a metal sheet 16, which is thin, is placed on the bottom of the tool in the form of a gutter 14. The metal of the foil is preferably the same as that of the metal part for which the insert is intended. It is for example a titanium alloy.

The coated yarns rest on the lower foil 16. They are stacked on one another for example in layers. The width of the layers, the number of the coated yarns that form the layers, may vary from the base to the upper layer. For example, the bundle may have a trapezoidal shape in cross section. A foil 15 is placed on the top of the stack of layers of coated yarns.

The number of yarns in the layers is not limiting; it depends on the part to be manufactured; the representation of the figures is simply an indication; the diameter of the yarns is not on the same scale as that of the gutter. The coated yarns are juxtaposed in the layers with no looseness or with a minimum of looseness between the yarns. At this stage the coated yarns have sustained no transverse stress.

Instead of layers, it is possible to have the yarns in subassemblies formed of elementary bundles that are brought together in a single bundle 13*f*.

Figure 3:
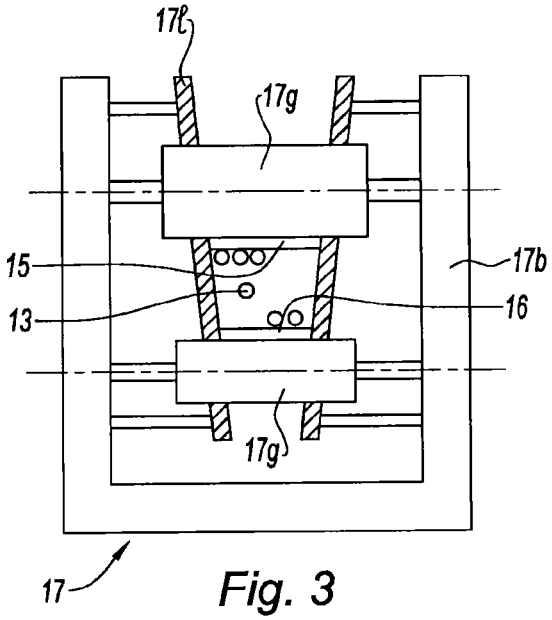
FIG. 3 shows the installation of FIG. 2 in front view.

The bundle 13*f* of coated yarns is thus guided through the shaping element 17 where it sustains a transverse compression. The shaping element in this instance comprises two rollers 17*g* with horizontal axes. As can be seen in FIG. 3, the rollers are rotatably mounted in a frame 17*b*. The spacing between the two rollers may be adjusted by vertical movement of their support. Appropriate motors, not shown, optionally rotate them. The contour of the passageway cross section of the shaping element is supplemented by two fixed supports forming sliders 171, placed laterally on either side of the bundle. The supports 171 are secured to the frame 17*b*. According to this example, they are inclined relative to the vertical. The contour of the passageway cross section of the shaping element is therefore trapezoidal.

Passing through the shaping element, the bundle of coated yarns takes the form of the shaping element, in this instance trapezoidal. At the outlet of the shaping element, it is therefore necessary to keep the bundle in the given shape.

Small foils 18 forming straps are then put in place to maintain the assembly, running round the bundle of coated yarns.

The bundle is thus pulled through the shaping element by means of a pulling tool using pincers for example.

Figure 4:
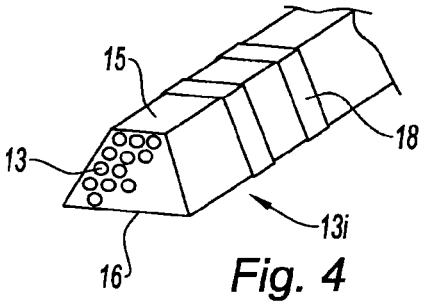
FIG. 4 shows an insert manufactured according to the invention.

The insert 13*i* is shown finished in FIG. 4.

It is understood that the present method is not limited to the production of inserts of square, rectangular or trapezoidal cross section. Many shapes are within the scope of those skilled in the art. It is possible to have in the shaping element a plurality of rolls or rollers around the bundle in order to give it a polygonal shape. The sides of the polygon may be straight but they may also be curved. It is sufficient to choose a convenient profile.

The shape and the transverse dimensions of the shaping element may be defined by the geometry and the dimensions of the insert that it is desired to use. In this case, the number of coated yarns necessary to form the insert is determined. Conversely, there may be a need for an insert with a determined number of coated yarns. In this case, the passageway cross section of the shaping element is adjusted so that it can contain the desired number of coated yarns at the outlet.

It is advantageous to have guiding elements that can be adjusted in position transversely in order to allow, in the retracted position, the bundle of coated yarns to be put in place before they are clamped onto the bundle. Adjusting the spacing of the rollers and of the metal supports makes it possible to adjust the cross section of the passageway and that in which the bundle of coated yarns comes out.

It may also be advantageous to place vibrating elements helping the coated yarns to consolidate in the bundle.

Figure 5:
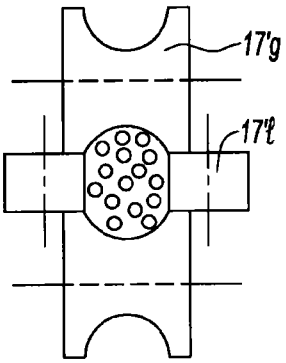
FIG. 5 shows a shaping die variant.

FIG. 5 shows another non-limiting exemplary embodiment of the shaping element. It is formed of two rollers 17'*g* with horizontal axes and with a curved profile interacting with two rollers 17'1 with vertical axes and a straight profile.

The present method also allows the production of a plurality of inserts simultaneously; the inserts are cut in the length of the bundle thus obtained.

Once the insert is finished, such as the one shown in FIG. 4, it is incorporated into a metal container according to the method known and described above to form a metal part. In comparison with the method of the prior art illustrated by FIG. 1 for producing an elongate part, rectilinear grooves are produced in which two rectilinear inserts are placed on each face of the container. For the rest, the method is the same.

According to a particular method for producing the metal part, one of the foils is used both as a support and as a cover of the metal container in which the insert is placed. The cover is welded onto the container while producing a vacuum in the part before the hot isostatic compaction treatment.

The invention claimed is:

1. A method for manufacturing an insert of elongate shape configured to be incorporated by CIC into a metal container, including coated yarns bound together, the coated yarns being formed of metal-coated ceramic fibers, the method comprising:

placing the coated yarns side by side in a bundle including a plurality of layers of coated yarns;

placing a first metal sheet on a top of the bundle and a second metal sheet on a bottom of the bundle;

pulling the bundle and the first and second metal sheets through a shaping element to compact the bundle transversely while forming the bundle and the first and second metal sheets with a determined cross section by the shaping element; and placing straps transversely clamping the bundle and the first and second metal sheets, downstream of the shaping element, wherein the shaping element includes first and second rollers which press against the first and second metal sheets, respectively, and first and second lateral sliders which contact first and second lateral sides of the bundle, respectively, during the pulling of the bundle, the first and second lateral sliders are secured to a frame on which the first and second rollers are rotatably mounted, and wherein the metal of the first and second metal sheets is the same as the metal of the metal container.

2. The method according to claim 1, wherein the first and second rollers have parallel axes.

3. The method according to claim 1, wherein a passageway cross section of the shaping element is polygonal with rectilinear or curved sides.

4. The method according to claim 1, a passageway cross section of the shaping element being oval or circular.

5. The method according to claim 1, wherein, before the coated yarns are grouped into the bundle, the coated yarns are placed in elementary bundles that are assembled together to form the bundle.

6. The method according to claim 1, wherein the straps being placed along the insert downstream of the shaping element.

7. A method for manufacturing a metal part comprising:

incorporation of an insert formed according to claim 1 in a metal container; and hot isostatic compaction of the assembly.

8. A part of elongate shape comprising at least one fibrous reinforcement in the longitudinal direction, obtained according to the method of claim 7, wherein cross section of the reinforcement has a non-rectangular shape, or a trapezoidal or oval shape.

9. The method according to claim 1, wherein the coated yarns of the bundle are free of transverse stress prior to the pulling of the bundle and the first and second metal sheets through the shaping element.

* * * * *